United States Patent [19]

Morrison

[11] Patent Number: 5,052,307

[45] Date of Patent: Oct. 1, 1991

[54] PALLET TRAY SYSTEM

[75] Inventor: Robert C. Morrison, Becker, Minn.

[73] Assignee: Viking Engineering & Development, Incorporated, Fridley, Minn.

[21] Appl. No.: 427,469

[22] Filed: Oct. 26, 1989

[51] Int. Cl.[5] ..... B65D 19/38

[52] U.S. Cl. ..... 108/53.1; 108/55.3; 108/901; 108/56.1

[58] Field of Search ..... 108/55.1, 55.3, 56.1, 108/901, 90, 53.1, 53.5

[56] References Cited

U.S. PATENT DOCUMENTS

| | | | |
|---|---|---|---|
| 1,007,727 | 11/1911 | Onken | 108/90 |
| 1,319,753 | 10/1919 | Bryant | 108/90 |
| 2,556,943 | 6/1951 | Reisman | 108/90 |
| 2,572,333 | 10/1951 | Gretjzer | 108/90 |
| 3,521,777 | 7/1970 | Vik | 108/55.3 X |
| 3,524,415 | 8/1970 | Heiman | 108/55.1 X |
| 4,254,873 | 3/1981 | Cook, III et al. | 108/55.3 X |

FOREIGN PATENT DOCUMENTS

| | | | |
|---|---|---|---|
| 1414638 | 11/1975 | United Kingdom | 108/55.3 |

*Primary Examiner*—Peter A. Aschenbrenner
*Attorney, Agent, or Firm*—Kinney & Lange

[57] ABSTRACT

A pallet tray system includes a tray attached to a top section of a wooden pallet. The wooden pallet has wings on at least two sides. Each wing has an engagable underside. The tray has a mechanism for engaging the undersides of the wings of the pallet to secure the tray.

26 Claims, 2 Drawing Sheets

PALLET TRAY SYSTEM

BACKGROUND OF THE INVENTION

1. Field of the Invention

The present invention relates to an industrial platform, and, in particular, to a tray mounted on a pallet.

2. Description of the Prior Art

In order to understand the requirements for an improved pallet, it is necessary to have some knowledge of the field of materials handling. The handling of materials involves the individual motions required to move commodities. The individual motions include lifting, translation and patterns of lifting and translation. Commodities moved include solid and liquid materials packaged in containers. Pallets have facilitated the handling of containers when pallets are used in concert with fork lifts. The combination of pallets and fork lifts additionally simplifies the lifting and transverse movement of large heavy objects not in containers.

Wood has historically been the most widely used material of construction for pallets. The advantages of wooden pallets have been a low cost, repairability and a capacity to carry a great quantity of weight.

Wooden pallets have commonly been transported bearing purchased materials from one business location to another (i.e. a manufacturer's warehouse to a distributor's warehouse) in order to hasten unloading. When a purchased material is shipped on a wooden pallet, the pallet adds extra weight to the shipment in transit and the pallet mass occupies space that might otherwise be used to transport additional purchased merchandise.

These problems are compounded if by agreement between the parties, pallets are to be returned to the pallet owner. Such a return trip is costly to the parties. Additionally, inequitable substitutions have been made in wooden pallet return agreements. These substitutions have been possible because a pallet owner could not indisputably identify its pallets.

A pallet assembly proposed to solve the return transportation and inequitable substitution problems is described by the Carnwath U.S. Pat. No. 4,059,057 issued Feb. 22, 1977. The assembly includes a heavy duty permanent pallet portion and a low cost expendable pallet skid. Board elements of the skid rest in alignment with the set of board elements of the permanent pallet. Board elements of the pallet skid are not attached to the permanent pallet. The inexpensive pallet skid is transported with the purchased material and is not returned to the pallet owner.

Another expendable pallet portion and a permanent pallet portion assembly is described in the Weber U.S. Pat. No. 2,754,077 issued July 10, 1956. A requirement of disassembly at the pallet's destination is a distinguishing feature. Additionally, the expendable portion of the Weber pallet has a function of providing lateral support for wirebound boxes.

A pallet assembly containing a nesting feature is described in the Sanders U.S. Pat. No. 3,664,272 issued May 23, 1972. The patent describes a nestable pallet constructed of thin boards and a plurality of tapered legs. The purchased material is secured to the pallet by steel strapping, heavy duty tape or some similar means.

Another pallet assembly which addresses the transportation expense problem is described in the Candella U.S. Pat. No. 4,267,780, issued May 19, 1981. The patent describes a disposable pallet board to which a box is firmly secured by straps. The pallet board is relatively thin and has the same horizontal dimensions as that of the base pallet.

Plastic was introduced as a material of pallet construction because plastic pallets weigh less than wooden pallets. Also plastic pallets are molded to secure containers specially fashioned to hold particular products. Additionally, a plastic pallet owner can readily identify its pallets by color or specialty molding marks.

Plastic pallets cost substantially more than wooden pallets. Also, if plastic pallets crack or break, they usually cannot be repaired. Wooden pallets can usually be repaired by replacing a damaged wooden member. Lastly, plastic pallets cannot support as large a weight load as can wooden pallets.

A plastic pallet assembly proposed to improve strength and load supporting ability is described in the Kreeger U.S. Pat. No. 4,597,338 issued July 1, 1986. The patent describes a plastic pallet made from two identical molded pallet halves that are snapped together to form a pallet.

A pallet assembly which includes molded pallet construction secured to wooden support members is described in the Skinner U.S. Pat. No. 3,654,874 issued Apr. 11, 1972.

The pallet assemblies described have not been entirely satisfactory.

SUMMARY OF THE INVENTION

The present invention includes a pallet tray attachable to a wooden pallet. The pallet has at least two edge portions or wings that extend laterally and have engagable undersides. The pallet tray overlays a top surface of the pallet and has an integral perimetric edge portion and a mechanism for engaging the undersides of the wings of the pallet. The mechanism for engaging the undersides is preferably disposed on two sides of the tray.

In one working embodiment, the tray is made from a high density polyethylene plastic. The top section of the tray contains a mechanism such as a perimetric ridge for engaging a second pallet placed on top of the tray. The top section of the tray also contains an array of ridges that engage grooves located on a bottom surface of a container.

DETAILED DESCRIPTION OF THE PREFERRED EMBODIMENTS

Figures 1, 2:
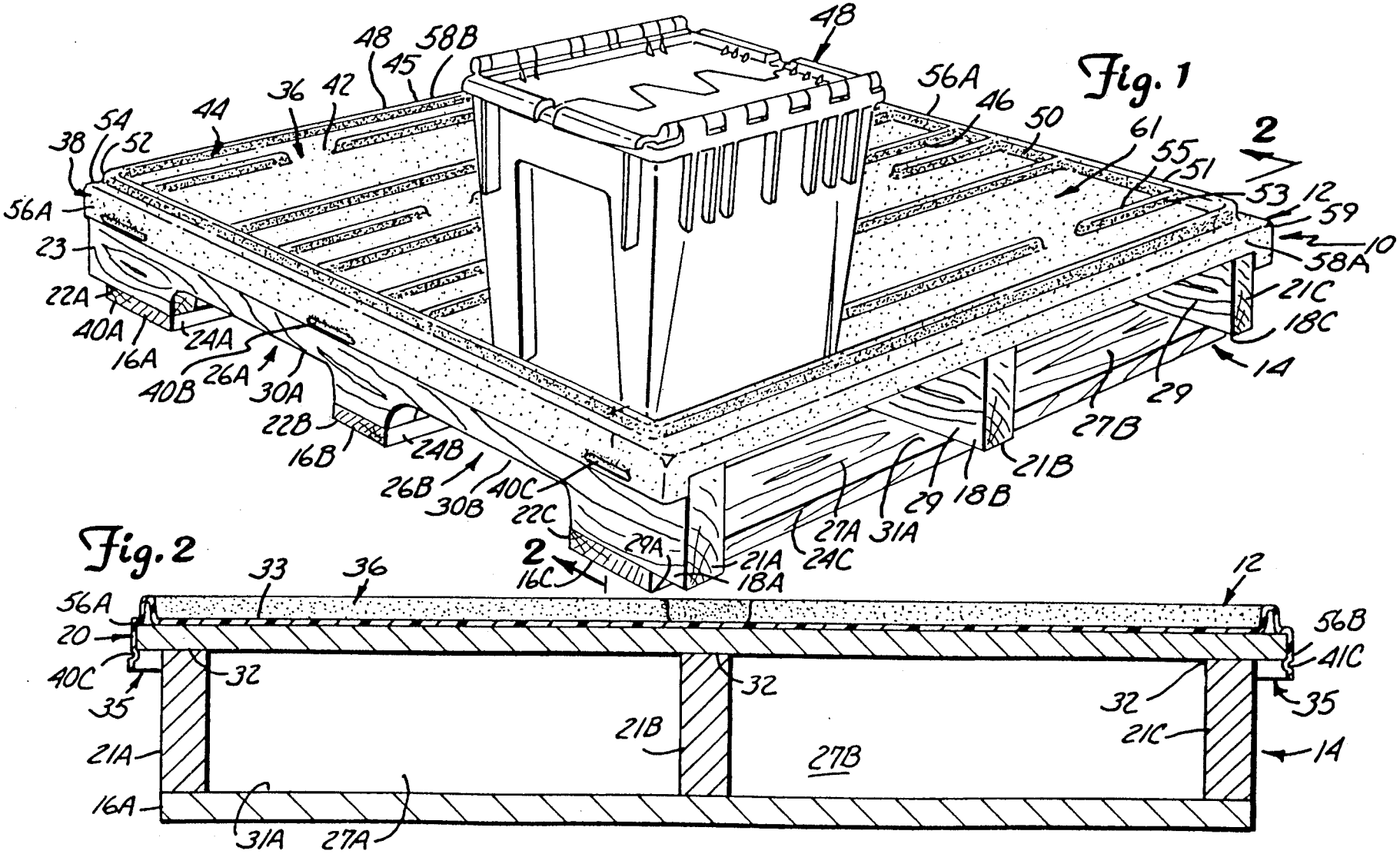
FIG. 1 is a perspective view of a plastic pallet tray on a wooden pallet of the present invention.
FIG. 2 is a sectional view of a pallet tray mounted on a wooden pallet taken along the line 2—2 in FIG. 1.

The plastic pallet tray system of the present invention is illustrated generally at 10 in FIG. 1. The pallet tray system includes a pallet tray 12, mounted on a wooden pallet 14. The pallet tray system of the present invention conserves space in transport, is repairable, identifiable by the owner, reasonably priced, durable, can take a substantial amount of weight, and is beneficial to the field of materials handling.

The wooden pallet 14 preferably includes a first peripheral bottom stringer 16A, an intermediate bottom stringer 16B and a second peripheral bottom stringer 16C. The stringers 16A, 16B and 16C support an assemblage of joists 18A, 18B and 18C. The intermediate stringer 16B is preferably centrally positioned within the wooden pallet 14. The peripheral bottom stringers 16A and 16C are aligned substantially parallel to the intermediate stringer 16B. The peripheral bottom stringers 16A and 16C are located approximately equidistant from the intermediate stringer 16B.

Preferably, the peripheral bottom stringer 16A has an end edge 22A which is even with a side edge 23 of the joist board 18A. The peripheral bottom stringer 16A also has a pair of opposing longitudinal side edges 24A which are disposed approximately perpendicular to the end edge 22A. Similarly, the peripheral stringer 16C has an end edge 22C preferably even with a side edge 23 of the joist 18A and a pair of opposing longitudinal side edges 24C which are disposed approximately perpendicular to the end edge 22C.

Each stringer 16A, 16B and 16C has an opposite end edge (not shown). The opposing end edges are also even with a side edge (not shown) of the joist 18C.

The assemblage of joists 18A-18C traverses the bottom stringers. The joists 18A-18C are disposed generally perpendicular to each of the bottom stringers 16A-16C.

The joists 18A, 18B and 18C have a set of openings 26A and 26B defined by cutout surfaces 30A and 30B. The cutout surfaces 30A and 30B are positioned approximately equidistant from the longitudinal midpoint of the joist. The set of openings 26A and 26B allows entry of fork lift tines (not shown) to lift the pallets. The upper joist surfaces 30A and 30B support the weight of the wooden pallet 14 when the pallet is lifted with the fork lift tines (not shown) positioned in the openings 26A and 26B.

The wooden pallet also has a set of fork lift openings 27A and 27B disposed approximately perpendicular to openings 26A and 26B as illustrated in FIG. 1. Each of the openings 27A and 27B is defined by a pair of facing side edge surfaces 29 of the joists. Each surface of the pair of facing side edge surfaces 29 is located on an opposite joist. A top surface 31A of the stringer 16A and a bottom surface 33 of a top board 20, as illustrated in FIG. 2, define the upper and lower boundaries, respectively, of the openings 27A and 27B.

The assemblage of joists 18A, 18B and 18C supports a collection of top boards indicated by 20 in FIG. 2. The top boards 20 are attached to an upper edge 32 of the joists. The top boards are disposed approximately perpendicular to the assemblage of joists 18A, 18B and 18C and generally parallel to the plurality of stringers 16A, 16B and 16C.

Figure 4:
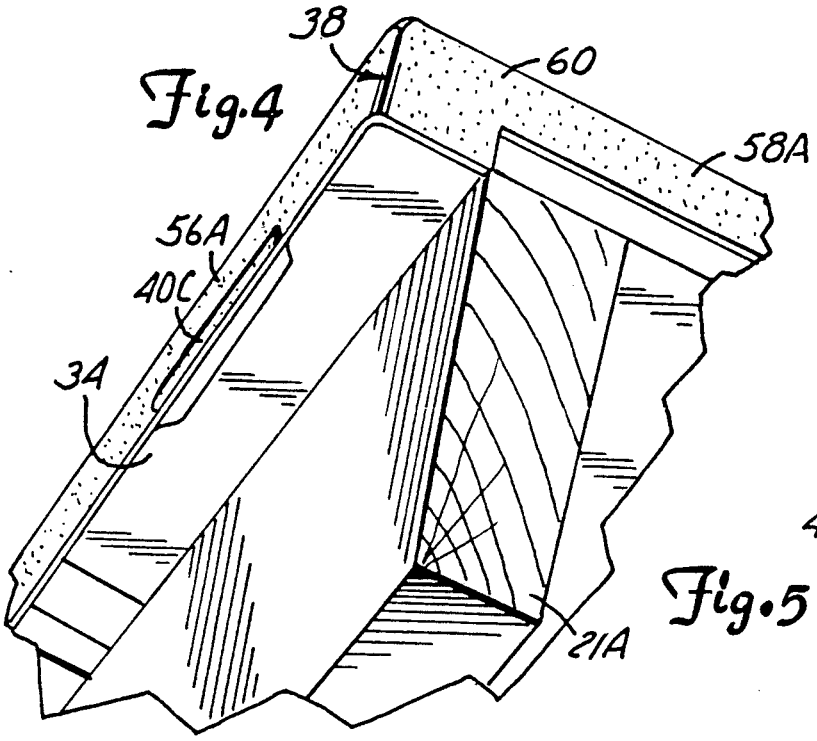
FIG. 4 is a perspective view of an underside of a corner of the wooden pallet and plastic pallet tray of the present invention.

Top boards 20 include portions 35 which extend beyond the side edge 23 of the joist 18A and correspondingly extend beyond a side end (not shown) of the joist 18C which are called wings. The top boards have a top surface 20A illustrated in FIG. 2 on which the pallet tray 12 rests and a bottom surface 34 illustrated in FIG. 4 which is engaged by a set of indents 40A, 40B, 40C and a set of opposing indents on the tray 12, representatively illustrated by 41C in FIG. 2.

In one working embodiment, the wooden pallet 14 has a width of 30" and a length of 32". Typically, a kiln dried wood such as southern yellow pine or Douglas fir is used to construct the wooden pallet. The particular wood is unimportant for purposes of the present invention.

The plastic pallet tray 12 illustrated in FIG. 1 includes a main body portion 36, a perimetric edge portion 38 and the set of indents 40A, 40B and 40C (and the opposing set of indents which is not shown) for engaging the bottom surface 34.

The main body portion 36 of the wooden pallet tray includes a top relatively flat surface 42, a perimetric outer ridge 44 outlining the relatively flat surface 42 and an inner array of ridges 47. The perimetric outer ridge 44 circumscribes the main body portion 36. The perimetric ridge 44 includes a rounded top surface 48 integral with a facing wall 50 facing the main body portion 36 of the pallet tray and a wall 52 opposing the main body portion 36 of the pallet tray 12 illustrated in FIG. 5. A relatively flat surface section 54 adjoins the opposing wall 52 of the perimetric ridge 44 and the perimetric edge portion 38. The flat surface section 54 overlays the wing 35.

When the pallet tray system 10 is nested, the wall 50 of the perimetric ridge 44 on the plastic pallet 12 meets the end edges 22A and 22C and longitudinal side edges 24A and 24C of the bottom stringers 16A and 16C of the wooden pallet 14. The facing wall 50 of the perimetric ridge 44 also contacts the end edge 22B of the intermediate alignment stringer 16B when the pallet system is nested. Correspondingly, the opposite end edges (not shown) of 16A, 16B and 16C abut an opposite facing wall (not shown) of the perimetric ridge 44. The perimetric ridge 44 secures the wooden pallet 14 and prevents the pallet system 10 from sliding while in a nested state. The perimetric ridge 44 also precludes the sliding of pallet trays 12 while the trays are in a nested stated.

The inner array of ridges 47 of the main body portion 36 of the plastic pallet tray 12 is bordered by the facing wall 50 of the perimetric ridge 44. The array of ridges 47 is ordered in a fashion that will affix a container 48 to the pallet tray system 10. The array of ridges is conformed to allow for a placement of pallet stringers on the main body surface during nesting. A ridge 55 within the array of ridges 47 has three integrated surfaces which include a top surface 51 and two coextensive wall surfaces 53. The container 48 has a bottom surface (not shown) which has grooves (not shown) into which the pallet tray array of ridges 47 fit. The array of ridges 47 functions to prevent lateral movement or slippage of the container which can occur during shipment and warehouse handling.

The inner array of ridges 47 has a diversity and variety to satisfy a user's needs. A particular ridge conformation or ridge array pattern is molded to accommodate most any type of container bottom groove conformation or pattern. Because the pallet tray system 10 has such versatility, the system is applicable in areas as diverse as the automotive industry and food industry.

The perimetric edge 38 of the plastic pallet tray 12 is integral with the flat surface 54. The perimetric edge 38 has a pair of opposing downwardly extending edge portions 56A and 56B as test illustrated in FIG. 2. The sets of indents 40A, 40B and 40C and the opposing set of indents representatively illustrated by 41C are disposed on the edge portions 56A and 56B, respectively. A pair of downwardly extending edge portions 58A and 58B as best illustrated in FIG. 1, extend downwardly about one-half the distance of the portions 56A and 56B. The portions 58A and 58B are conformed to avoid contact with fork lift tines (not shown) when the tines are inserted into the openings 27A and 27B for the purpose of elevating the pallet tray system 10. A risk of damage to the pallet tray system 10 is minimized by preventing contact between the fork lift tines and perimetric edge 38 of the pallet tray 12 at the openings 27A and 27B.

Figure 3:
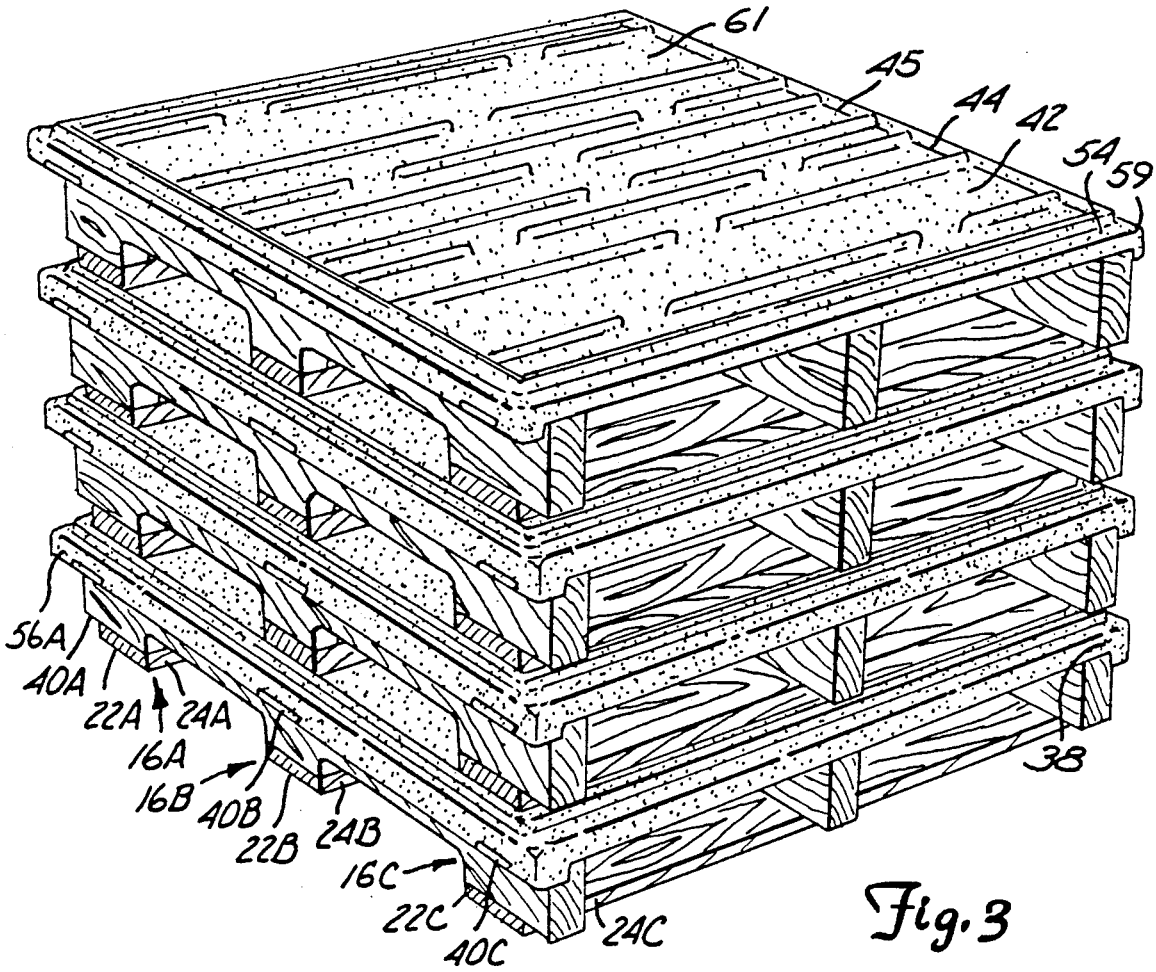
FIG. 3 is a perspective view illustrating wooden pallets with plastic pallet trays of the present invention in a nested position.

The set of indents 40A, 40B and 40C and the opposing set of indents representatively illustrated by 41C are positioned approximately equidistantly along the portions 56A and 56B, respectively. In one working embodiment illustrated in FIG. 3, the indents 40C and 41C are positioned along the bottom stringer 16C.

Figure 5:
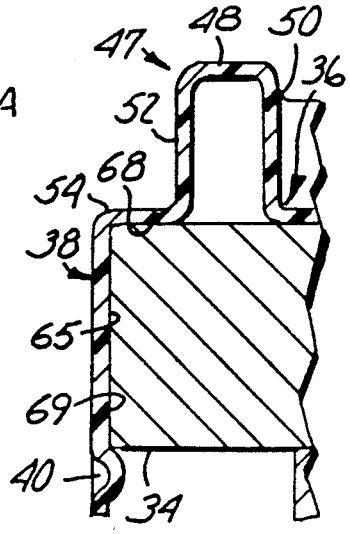
FIG. 5 is an enlarged sectional view of an edge portion of the plastic pallet tray and wooden pallet.

Each wing 35, as illustrated in FIG. 5, abuts an inside surface 65 of the pallet tray perimetric edge portion 38. The indents, as represented by 40C, secure the pallet tray 12 to the pallet by engaging the underside surface 34 of the wing 35. The pallet tray is secured by manually flexing the indents outwardly. The pallet tray is detached in the same manner.

The plastic pallet tray 12 is attached to the wooden pallet 14 by flexing the portions 58A and 58B outwardly. The indents engage the bottom surface 34 of the top board wing when the portions flex back to their original position. The indents secure the tray to the pallet by acting against the bottom surface 34. The installation is estimated to take about two seconds of time to complete. No tools are required for installation.

In one working embodiment, the plastic pallet tray is molded of high density polyethylene HDPE plastic. Other thermalset plastics are also usable. Either a vacuum forming process, a compression process or a rotational molding process is used to mold the plastic pallet tray. The high density polyethylene plastic is rigid but soft enough to resist deformation upon impact. The HDPE plastic is also nonreactive when in contact with a broad range of chemicals and is resistant to change over a wide range of temperature. Lastly, the HDPE plastic is FDA approved.

The plastic pallet tray has a black color with a nonskid pebble finish. The color of the pallet tray is alterable at manufacture. The versatility permits the user to match the pallet tray color to the container's color in a scheme to color code parts.

In one working embodiment, a 32" by 30" plastic pallet tray is rated to support 2485 pounds when stacked across joists and to support 2865 pounds when stacked across stringers. Additionally, the pallet tray system had a life of about 249 trips with about 173 trips before the anticipated need for first repair.

The wooden pallet tray system has a number of features which are superior to features of either a nonwooden pallet or the wooden pallet alone. The wooden pallet is repairable if one of the elements is cracked or broken. The defective element is simply removed and replaced with a new member. A new wooden member is simply fastened with nails. The repairability of the wooden pallet tray system is in sharp contrast to the repairability of prior art plastic pallets. Elements of prior art plastic pallets cannot be mended. The entire prior art plastic pallet must be replaced. Additionally, because the wooden pallet is biodegradable, it is environmentally compatible.

Although the present invention has been described with reference to preferred embodiments, workers skilled in the art will recognize that changes may be made in form and detail without departing from the spirit and scope of the invention.

What is claimed is:

1. A tray for attaching to a wooden pallet having a top surface and outwardly extending edge portions on at least two sides, each edge portion having an edge surface and an engagable underside, the tray comprising:

a top section for overlaying a top surface of a pallet;

a perimetric edge portion integral with the top section and having two sides, each side extending over an edge surface of a pallet; and means for engaging an underside of an edge portion of a pallet including an indented segment, the means for engaging an underside being disposed on each of the two sides extending over an edge surface of an edge portion of a pallet.

2. The tray of claim 1 for use with a container having grooves in a bottom surface and wherein the top section includes means for engaging the grooves of the container.

3. The tray of claim 2 wherein the means for engaging the grooves of the container includes an array of ridges.

4. The tray of claim 1 wherein the tray further includes means for nesting the tray with another tray.

5. The tray of claim 4 wherein the means for nesting includes a perimetric ridge.

6. The tray of claim 1 wherein the top section includes means for nesting the tray with a pallet.

7. The tray of claim 6 wherein the means for nesting the tray includes a perimetric ridge.

8. The tray of claim 1 and including a thermalset plastic as a material of construction.

9. The tray of claim 8 wherein the thermalset plastic is a high density polyethylene plastic.

10. The tray of claim 1 wherein the indented segment is movable outwardly.

11. The tray of claim 1 wherein an engagable underside of a pallet is engaged by the indented segment.

12. The tray of claim 1 and including a plurality of indented segments disposed on each of the two sides extending over an edge portion of a pallet.

13. The tray of claim 12 wherein three indented segments disposed on each side thus extends over an edge portion of a pallet.

14. A pallet tray system comprising:

a wooden pallet having a bottom stringer section and a joist section attached to the stringer section and having a pallet top section attached to the joist section, the top section having edge portions extending outwardly on at least two sides thereof and each edge portion having an engagable underside;

a tray having a tray top section for overlaying the top section of the pallet and having a perimetric edge portion integral with the tray top section, and further having two sides, each side extending over one of the edge portions, and the tray further having means for engaging the undersides of the edge portions of the pallet including an indented segment, and the means for engaging being disposed on each of the two sides extending over the edge portions of the pallet.

15. The pallet tray system of claim 14 wherein the pallet tray top section includes means for nesting another wooden pallet.

16. The system of claim 15 wherein the means for nesting another wooden pallet includes a perimetric ridge.

17. The system of claim 15 wherein the means for nesting another wooden pallet includes an array of ridges.

18. The system of claim 14 for use with a container having grooves in a bottom surface and wherein the top section includes means for engaging the grooves of the container.

19. The system of claim 18 wherein the means for engaging the grooves of the container includes an array of ridges.

20. The system of claim 14 wherein the tray is made of a thermalset plastic.

21. The system of claim 20 wherein the thermalset plastic is a high density polyethylene plastic.

22. The system of claim 14 wherein the indented segment is flexible outwardly.

23. The system of claim 14 wherein the indented segment is molded integrally with the tray.

24. The system of claim 14 wherein the engagable underside of the pallet is engaged by the indented segment.

25. The system of claim 14 and further including a plurality of indented segments disposed on each of the two sides thus extend over the edge portions of the pallet.

26. The system of claim 25 wherein three indented segments are disposed on each side extending over the edge portions.

* * * * *

UNITED STATES PATENT AND TRADEMARK OFFICE

CERTIFICATE OF CORRECTION

PATENT NO. : 5,052,307

DATED : October 1, 1991

INVENTOR(S) : Robert C. Morrison

It is certified that error appears in the above-identified patent and that said Letters Patent is hereby corrected as shown below:

Title page, item [56], col. 2, line 2,

In the References Cited Section, under U.S. PATENT DOCUMENTS, add the following:

| | | | |
|---|---|---|---|
| 2,754,077 | 7/1956 | Weber | 248/120 |
| 3,654,874 | 4/1972 | Skinner | 108/51 |
| 3,664,272 | 5/1972 | Sanders | 108/53 |
| 4,059,057 | 11/1977 | Carnwath | 108/51.1 |
| 4,267,780 | 5/1981 | Candella | 108/52.1 |
| 4,597,338 | 7/1986 | Kreeger | 108/51.1 |

Signed and Sealed this

Nineteenth Day of July, 1994

Bruce Lehman

BRUCE LEHMAN

*Commissioner of Patents and Trademarks*

*Attest:*

*Attesting Officer*